US007694838B2

(12) United States Patent
Yang et al.

(10) Patent No.: US 7,694,838 B2
(45) Date of Patent: Apr. 13, 2010

(54) TRASH CAN LINER WITH BAG SECURING MECHANISM

(75) Inventors: Frank Yang, Rancho Palos Verdes, CA (US); Myk Wayne Lum, Irvine, CA (US)

(73) Assignee: simplehuman, LLC, Torrance, CA (US)

( * ) Notice: Subject to any disclaimer, the term of this patent is extended or adjusted under 35 U.S.C. 154(b) by 1227 days.

(21) Appl. No.: 10/940,167

(22) Filed: Sep. 14, 2004

(65) Prior Publication Data

US 2006/0056741 A1 Mar. 16, 2006

(51) Int. Cl.
*B65F 1/08* (2006.01)

(52) U.S. Cl. ..... 220/495.11; 220/908.1

(58) Field of Classification Search ..... 220/908, 220/23.87

See application file for complete search history.

(56) References Cited

U.S. PATENT DOCUMENTS 1,922,729 A * 8/1933 Geibel ..... 220/23.89
2,457,274 A 12/1948 Rifken
3,820,200 A 6/1974 Myers
3,825,150 A 7/1974 Taylor
4,027,774 A 6/1977 Cote
4,189,808 A 2/1980 Brown
4,357,740 A 11/1982 Brown
4,457,483 A 7/1984 Gagne
4,535,911 A 8/1985 Goulter
4,570,304 A 2/1986 Montreuil et al.
4,576,310 A 3/1986 Isgar et al.
4,664,347 A 5/1987 Brown et al.
4,697,312 A 10/1987 Freyer
4,763,808 A 8/1988 Guhl et al.
4,834,260 A 5/1989 Auten
4,867,339 A 9/1989 Hahn
4,884,717 A 12/1989 Bussard et al.
4,892,224 A 1/1990 Graham
4,923,087 A 5/1990 Burrows
4,964,523 A 10/1990 Bieltvedt et al.
5,031,793 A 7/1991 Chen et al.
5,054,724 A 10/1991 Hutcheson
5,065,891 A 11/1991 Casey
5,100,087 A 3/1992 Ashby
5,222,704 A 6/1993 Light
5,261,553 A 11/1993 Mueller et al.
5,314,151 A 5/1994 Carter-Mann
5,381,588 A 1/1995 Nelson
5,404,621 A 4/1995 Heinke
5,419,452 A 5/1995 Mueller et al.
5,501,358 A 3/1996 Hobday
5,611,507 A 3/1997 Smith
5,628,424 A 5/1997 Gola
5,632,401 A 5/1997 Hurd
5,636,416 A 6/1997 Anderson
5,645,186 A 7/1997 Powers et al.
D383,277 S 9/1997 Peters
5,690,247 A 11/1997 Boover
5,695,088 A 12/1997 Kasbohm
D388,922 S 1/1998 Peters
D389,631 S 1/1998 Peters
5,704,511 A 1/1998 Kellams
5,730,312 A 3/1998 Hung
5,732,845 A 3/1998 Armaly, Jr.
5,735,495 A 4/1998 Kubota
5,738,239 A 4/1998 Triglia
5,816,431 A 10/1998 Giannopoulos
D401,719 S 11/1998 Van Leeuwen et al.
5,873,643 A 2/1999 Burgess, Jr. et al.
5,881,901 A 3/1999 Hampton
5,887,748 A 3/1999 Nguyen
5,987,708 A 11/1999 Newton
6,102,239 A 8/2000 Wien
6,123,215 A 9/2000 Windle
6,126,031 A 10/2000 Reason
6,234,339 B1 5/2001 Thomas
D445,980 S 7/2001 Tjugum
6,286,706 B1 9/2001 Tucker
6,557,716 B1 5/2003 Chan
6,659,407 B2 12/2003 Asaro
6,681,950 B2 1/2004 Miller, Jr. et al.
7,080,750 B2 7/2006 Wein et al.
7,243,811 B1 7/2007 Ramsey (Continued)

FOREIGN PATENT DOCUMENTS

DE 4225936 A1 2/1994

(Continued)

OTHER PUBLICATIONS

Entire File History of U.S. Patent No. 7,243,811, including Rule 131 Declaration signed Feb. 12, 2007.

(Continued)

*Primary Examiner*—Stephen Castellano
(74) *Attorney, Agent, or Firm*—Knobbe, Martens, Olson & Bear LLP

(57) ABSTRACT

A liner for use in a trash can has a body having a surrounding wall and a top edge that defines a mouth, and a trash bag securing mechanism provided on the body adjacent the top edge. A user can insert a trash bag into the liner, open the mouth of the trash bag and then secure a portion of the trash bag to the trash bag securing mechanism.

3 Claims, 3 Drawing Sheets

U.S. PATENT DOCUMENTS

| | | | |
|---|---|---|---|
| 7,404,499 | B1 | 7/2009 | Ramsey |
| 2001/0002690 | A1 | 6/2001 | Rosky |
| 2002/0096524 | A1 | 7/2002 | Hardesty |
| 2003/0089719 | A1 | 5/2003 | Berger |
| 2004/0200938 | A1 | 10/2004 | Forlivio |
| 2005/0017010 | A1 | 1/2005 | Siegel et al. |
| 2006/0056741 | A1 | 3/2006 | Yang et al. |
| 2006/0213910 | A1 | 9/2006 | Yang et al. |
| 2006/0226149 | A1 | 10/2006 | Yang et al. |
| 2007/0012699 | A1 | 1/2007 | Yang et al. |
| 2007/0034334 | A1 | 2/2007 | Ramsey et al. |
| 2007/0289972 | A1 | 12/2007 | Wynn et al. |
| 2008/0011754 | A1 | 1/2008 | Ramsey |
| 2008/0011910 | A1 | 1/2008 | Ramsey |
| 2008/0237234 | A1 | 10/2008 | Yang et al. |
| 2008/0257889 | A1 | 10/2008 | Kovacevich et al. |
| 2008/0257890 | A1 | 10/2008 | Kovacevich et al. |
| 2008/0257891 | A1 | 10/2008 | Kovacevich et al. |
| 2008/0264948 | A1 | 10/2008 | Kovacevich et al. |
| 2008/0264950 | A1 | 10/2008 | Kovacevich et al. |
| 2008/0272127 | A1 | 11/2008 | Kovacevich et al. |

FOREIGN PATENT DOCUMENTS

| | | |
|---|---|---|
| EP | 0582240 | 7/1993 |

OTHER PUBLICATIONS

Exhibits A, B1, B2, C1, C2 cited in Dec. 12, 2006 IDS in U.S. Patent No. 7,243,811.
U.S. Appl. No. 60/595,868 (Ramsey).
U.S. Appl. No. 60/595,920 (Ramsey).

* cited by examiner

TRASH CAN LINER WITH BAG SECURING MECHANISM

BACKGROUND OF THE INVENTION

1. Field of the Invention

The present invention relates to a trash can assembly, and in particular, to a liner that is used with a trash can assembly, the liner having a mechanism for allowing a trash bag to be tied tightly to the liner.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid. In addition, many trash cans are provided with a liner or inner shell that fits inside the outer shell. A trash bag is usually placed inside the liner for receiving trash. The trash bag can be replaced after it is filled with trash.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to toss trash, or to change the plastic liner or bag that is used to line the trash can.

Despite these improvements, there are still drawbacks associated with the liner and the trash bag. For example, most trash bags are inserted into the liner, with the top open mouth of the trash bag folded over the top annular edge of the liner in a manner such that the top of the trash bag lies loosely over the top annular edge of the liner. This loose fit is not desirable because a heavy piece of trash may cause the folded top of the trash bag to slip, thereby resulting in the trash bag slipping or slumping into the inside of the liner. If the trash bag is relatively full, some of the trash stored inside the trash bag can therefore spill into the liner.

SUMMARY OF THE DISCLOSURE

It is an object of the present invention to allow a user to tie a trash bag securely to the mouth or opening of a liner of a trash can assembly to prevent the trash bag from slipping into the liner.

It is another object of the present invention to provide a liner for a trash can assembly with a mechanism that allows for a trash bag to be securely tied to the mouth or opening of the liner.

It is another object of the present invention to provide a liner for a trash can assembly with a mechanism that allows for the mouth of a trash bag to be kept open at the mouth or opening of the liner.

In order to accomplish the objects of the present invention, there is provided a liner for use in a trash can, the liner having a body having a surrounding wall and a top edge that defines a mouth, and a trash bag securing mechanism provided on the body adjacent the top edge. A user can insert a trash bag into the liner, open the mouth of the trash bag and then secure a portion of the trash bag to the trash bag securing mechanism.

In one embodiment of the present invention, the trash bag securing mechanism is an opening, and the user can insert the portion of the trash bag through the opening.

DETAILED DESCRIPTION OF THE PREFERRED EMBODIMENTS

Figure 1:
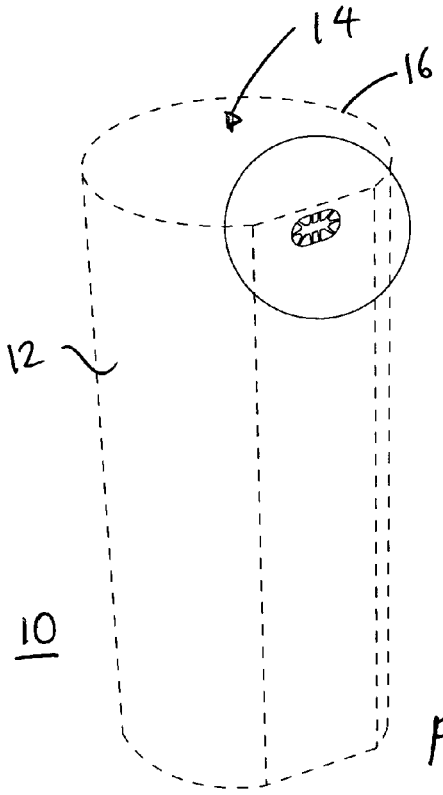
FIG. 1 is a perspective view of a trash can liner according to one embodiment of the present invention.
Figure 2:
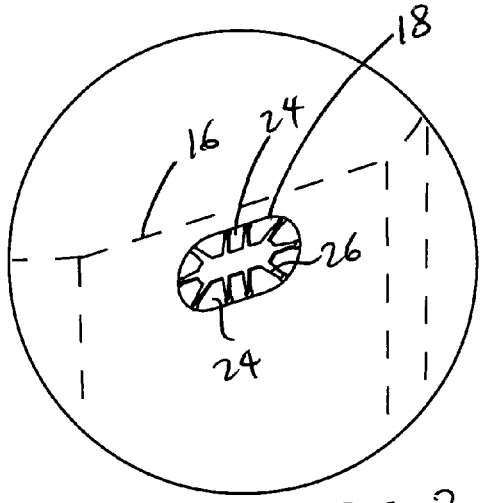
FIG. 2 is an enlarged view of the section A of the liner of FIG. 1.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1-6 illustrate one embodiment of a trash can liner 10 according to the present invention. The trash can liner 10 is intended for use with any conventional trash can T, including plastic and metal trash cans. The liner 10 is typically inserted into the hollow interior of a trash can T and retained therein. The liner 10 can be made of plastic or metal.

The liner 10 can be provided in any desired shape and size to fit the shape and size of the trash can. The liner 10 has a body with a surrounding wall 12 and a mouth 14 defined by a top edge 16. A trash bag securing mechanism is provided in the wall 12 at a location near the top edge 16, and functions to tie or otherwise secure the open mouth of the trash bag to the open mouth 14 of the liner 10. In the embodiment illustrated in FIGS. 1-5, the trash can securing mechanism is embodied in the form of an opening 18. The opening 18 allows a portion 22 near the top of the trash bag 20 (shown in phantom in the FIGS.), near the mouth M of the trash bag 20, to be inserted therethrough (i.e., so that the portion 22 is pinched), from the outside of the liner 10 towards the inside of the liner 10. As a result, the rest of the mouth M of the trash bag 20 can be cinched or snugly fitted around the top edge 16 of the liner 10 (see FIG. 3) so that the mouth M of the trash bag 20 can be completely opened to receive trash items. The portion 22 of the trash bag 20 inserted through the opening 18 is also removably secured to (i.e., similar to being tied at the location of) the opening 18, thereby keeping the mouth M of the trash bag 20 opened, and maintaining the mouth of the trash bag 20 at the location of the top edge 16 of the liner 10, and in an open state, during use. This prevents the trash bag 20 from slipping or slumping into the inside of the liner 10 when the trash bag 20 is filled with heavier trash.

The opening 18 can be provided with fins 24 that extend into the opening 18. The fins 24 are spaced apart from each other by spaces 26. The fins 24 can be flexed, so that the fins 24 and the spaces 26 can clip the portion 22 of the trash bag 20 to the opening 18 to effectively secure the portion 22 at the opening 18. The fins 24 can be made from the same material as the liner 10, or from a different material to provide different degrees of flexibility.

Figure 3:
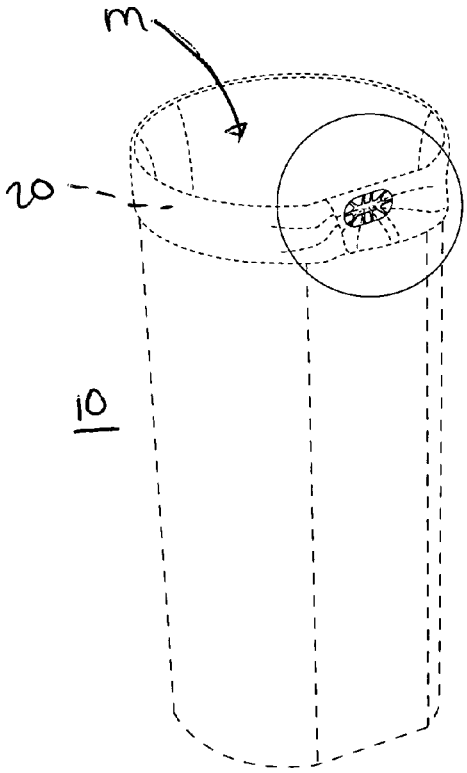
FIG. 3 is a perspective view of the liner of FIG. 1 shown with a trash bag secured therein.
Figure 4:
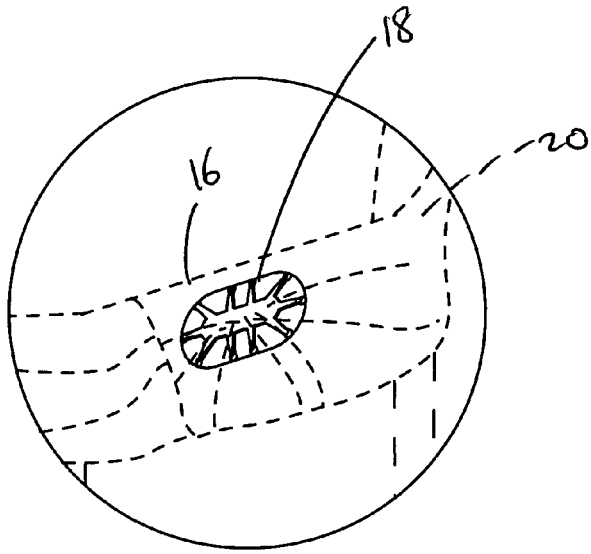
FIG. 4 is an enlarged view of the section B of the liner of FIG. 3.
Figure 5:
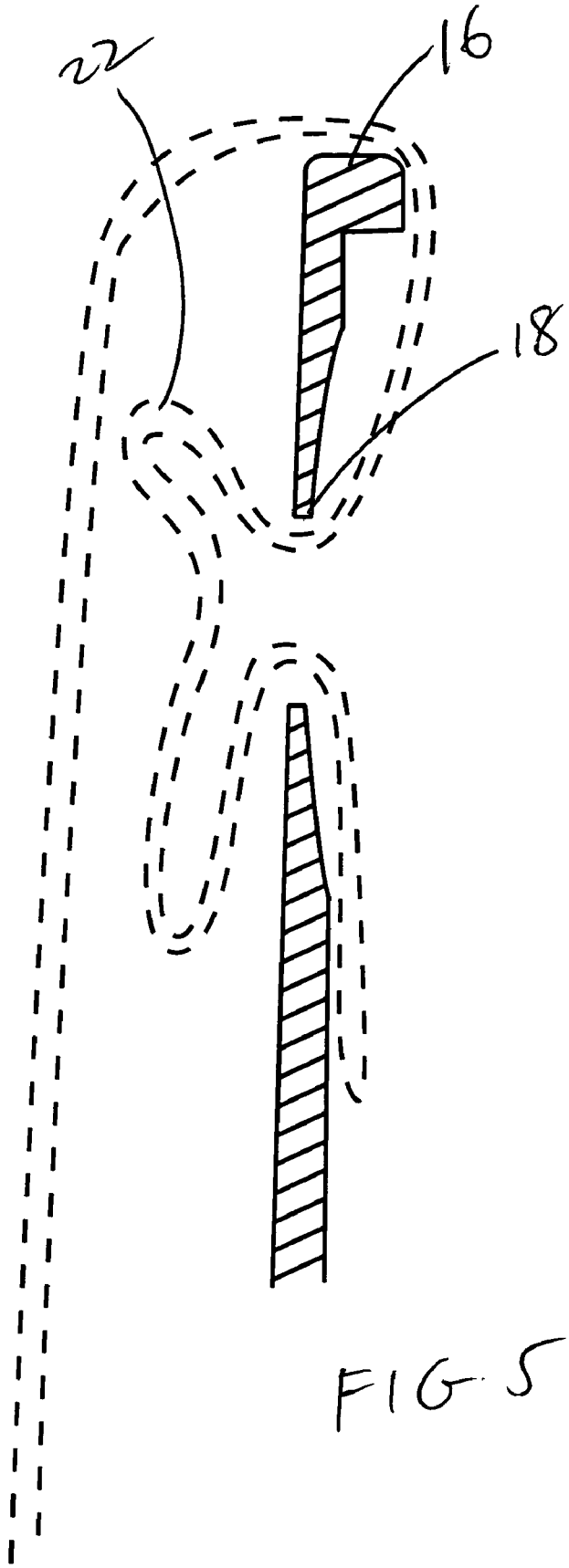
FIG. 5 is an enlarged cross-sectional view of the section B of the liner of FIG. 3.
Figure 6:
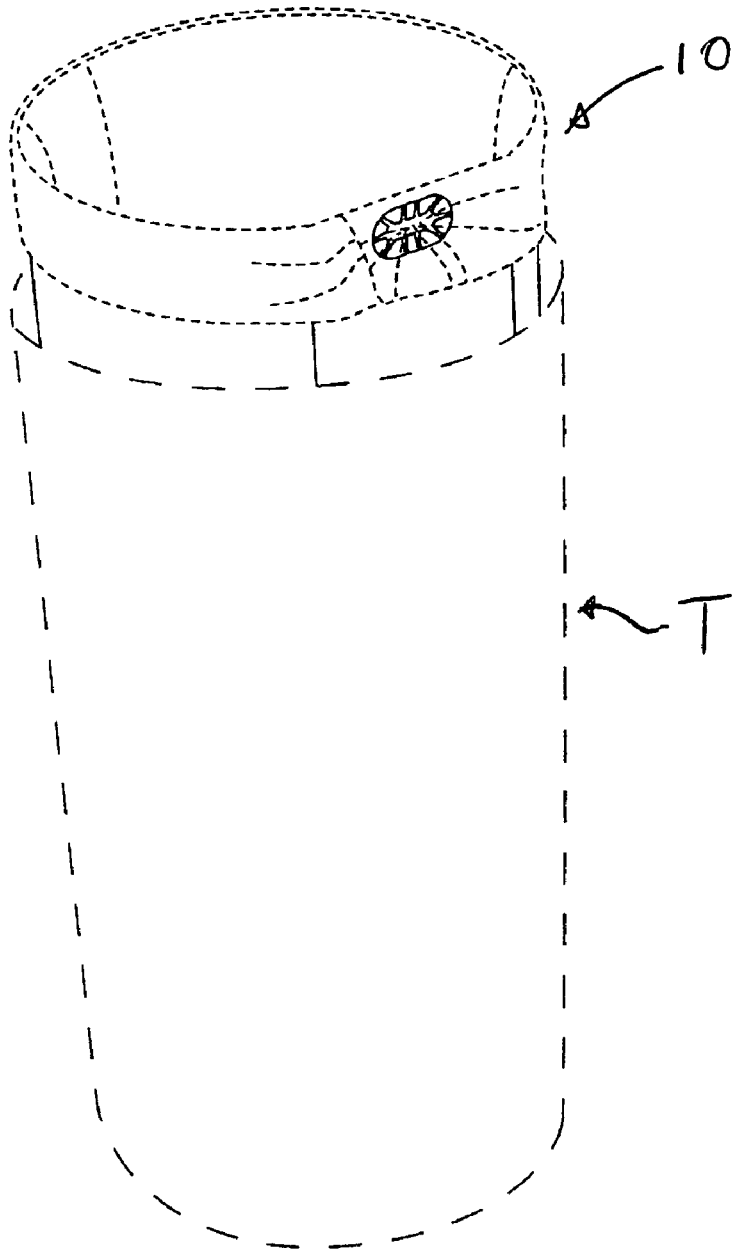
FIG. 6 is an exploded perspective view illustrating the liner of FIG. 3 in use with a conventional trash can.

In use, the user can insert a conventional trash bag 20 into the liner 10, open the mouth of the trash bag 20, squeeze a portion 22 together near the mouth of the trash bag 20, and then insert the portion 22 through the opening 18. This is shown in FIGS. 3-5. The trash bag 20 can now be used to contain trash, and will not slip or slump into the interior of the liner 10 because (i) its mouth M is held open at the top edge 16 of the liner 10, and its mouth M is secured to the opening 18.

To replace the trash bag 20, the user merely pulls the portion 22 out of the opening 18, ties the trash bag 20 to close its mouth M, and then lifts the trash bag 20 out of the liner 10. A new trash bag 20 can be installed in the manner described above.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can, comprising:

an outer shell structure having a lower end portion and extending upwardly from the lower end portion to an upper end portion, the shell structure defining a cavity disposed below the upper end portion;

a liner body having a surrounding wall and an upper portion including a top edge that defines a mouth, the body being configured to fit inside the cavity of the outer shell structure; and wherein the liner body further comprises a trash bag securing mechanism configured to secure a top end of a trash bag to the liner body, the trash bag securing mechanism further comprising an oblong opening having a major axis and a minor axis and first and second ends at opposite ends of the major axis, the oblong opening having a width along the minor axis, the minor axis extending generally transverse to the top edge of the liner body, the trash bag securing mechanism further comprising a plurality of slots extending inwardly from a periphery of the trash bag securing mechanism, each slot terminating at an outer terminal end of the slot and extending inwardly from the terminal end toward the oblong opening, each slot further including an inner end having an opening connecting the slot with the oblong opening, each slot also including a width that is smaller than the width of the oblong opening, and wherein at least a first plurality of the slots are disposed at the first end of the trash bag securing mechanism and a second plurality of slots are disposed at the second end of the trash bag securing mechanism.

2. The liner of claim 1, wherein the body further includes fins extending into the opening, with the fins separated by said slots.

3. The liner of claim 1, wherein the portion of the trash bag is adjacent the top end of the trash bag.

* * * * *